US005595322A

United States Patent [19]

Kramer

[11] Patent Number: 5,595,322

[45] Date of Patent: Jan. 21, 1997

[54] MICROSEAMED METALLIC CAN

[76] Inventor: Antonio H. Kramer, San Paulo, Brazil

[21] Appl. No.: 180,647

[22] Filed: Jan. 13, 1994

Related U.S. Application Data

[60] Division of Ser. No. 45,436, Apr. 8, 1993, Pat. No. 5,320,468, which is a continuation-in-part of Ser. No. 729,331, Jul. 12, 1991, abandoned.

[30] Foreign Application Priority Data

Jul. 13, 1990 [BR] Brazil ..... 9003371

[51] Int. Cl.[6] ..... B65D 8/20

[52] U.S. Cl. ..... 220/619

[58] Field of Search ..... 220/619, 620, 220/610, 615, 309

[56] References Cited

U.S. PATENT DOCUMENTS

| | | | |
|---|---|---|---|
| 4,102,467 | 7/1978 | Woodley | 220/619 |
| 4,293,090 | 10/1981 | Gardner et al. | 220/619 |
| 4,467,933 | 8/1984 | Wilkinson et al. | 220/623 |
| 4,485,663 | 12/1984 | Gold et al. | 72/347 |
| 4,538,758 | 9/1985 | Griffith | 220/619 |
| 4,735,863 | 4/1988 | Bachmann et al. | 220/619 |
| 4,784,282 | 11/1988 | Le Bret et al. | 220/619 |
| 5,078,564 | 1/1992 | Zago | 413/4 |
| 5,100,017 | 3/1992 | Ishinabe et al. | 220/669 |
| 5,249,541 | 10/1993 | Sato et al. . | |

FOREIGN PATENT DOCUMENTS

| | | | |
|---|---|---|---|
| 0212346 | 9/1991 | Japan | 220/619 |

*Primary Examiner*—Stephen J. Castellano
*Attorney, Agent, or Firm*—Dvorak and Traub

[57] ABSTRACT

The present invention refers to a can having a seam formed by a seaming process, through which it is possible to produce cans by seaming (fixing) tops and ends to bodies of cans by micro-seaming process. This seamed can is made by using materials with 0.16 mm thickness or less, with a high hardness DR8 or DR9 for making tops and ends. As a result of the micro-seaming process a significant reduction of dimensions has been obtained on the cover and body hooks and in the length of the seam, without changing volumetric capacity of the can.

10 Claims, 7 Drawing Sheets

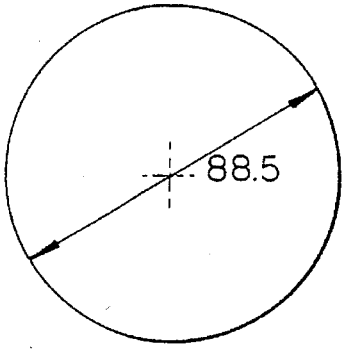
FIG. 5 PRIOR ART
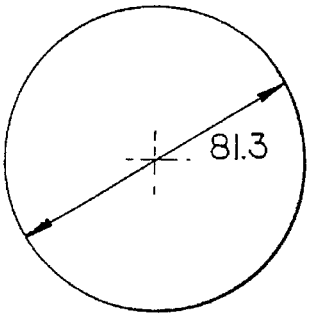
FIG. 6
FIG. 7 PRIOR ART
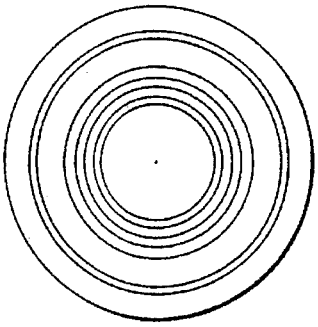
FIG. 8
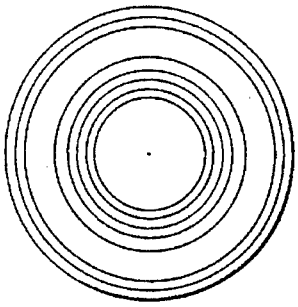
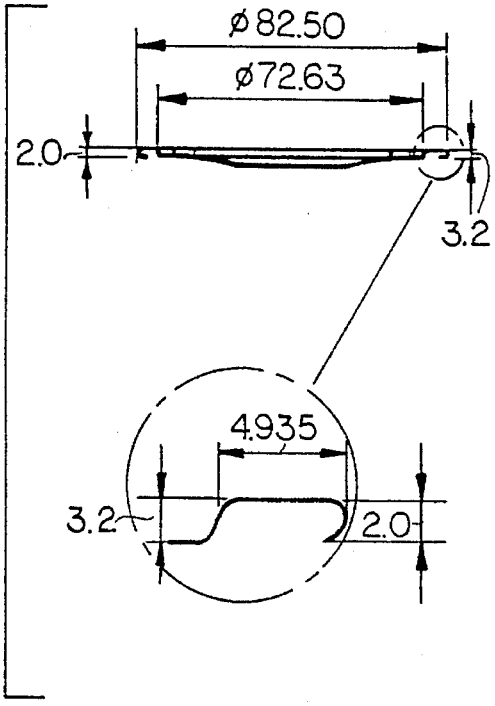
FIG. 9
PRIOR ART
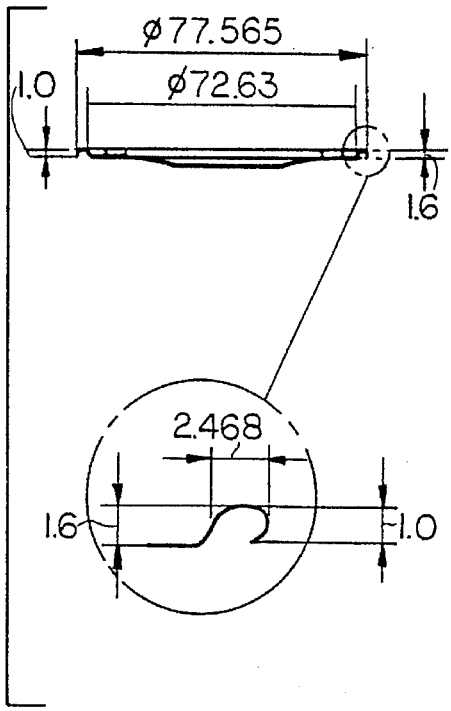
FIG. 10

MICROSEAMED METALLIC CAN

The present application is a divisional application of allowed U.S. patent application Ser. No. 08/045,436 filed Apr. 8, 1993, now U.S. Pat. No. 5,320,468, for which the issue fee was paid on Dec. 16, 1993 and claims priority pursuant to 35 USC 120. Application Ser. No. 08/045,436 is a CIP of Ser. No. 07/729,331 filed on Jul. 12, 1991, now abandoned.

The object of the present invention patent is a metallic can having a seam formed by a seaming process and refers particularly to the means of seaming the top and the bottom by which, due to a substantial reduction of the dimensions of the hooks and other fixing folds, a considerable and advantageous reduction of the diameters of the cut-outs of the material employed for the manufacture of the top and end of a can is obtained, as well as, consequently, a significant reduction of the height of the can body and this without change of the holding capacity of the can. This is a process from which substantial savings of metal sheet results, both in quantity as well as by employing a thinner and harder sheet metal, i.e. of 0.16 mm thickness and DR8 temper, the price of which is 21.2 to 28.3% lower than that of the conventionally used metal sheet, i.e. of 0.22 to 0.24 mm thickness and the normal temper required.

As is known to those with knowledge of the matter, the currently used conventional cans designed to serve as packing for the most diverse products, particularly for food products and the so-called sanitary cans, are normally obtained by using tinplate of 0.22 to 0.24 mm thickness with the normal temper required for the top and the end of a can, features which would also allow the employment of this metal sheet for micro-seaming, however, without the advantages of large savings of 21.2 to 28.3% obtained as a result of the use of a metal sheet of 0.16 mm thickness and DR8 temper, as outlined by this new process.

The subject new metallic can will provide substantial savings, both by the substantial reduction of diameters of the cut-outs for the top and the end of a can, and this as a consequence of the reduction of the dimensions of the hooks and other fixing folds, as well as by the reduction of height provided to the can body without changing its holding capacity, savings which become more significant due to the employment of a thinner and harder metal sheet, i.e. of 0.16 mm thickness with DR8 temper, as compared to the conventionally used metal sheet of 0.22 to 0.24 mm thickness and the normal temper required for the top and the end of a can.

This new metallic can can be made with an electrically welded (3 piece cans) or deep drawn body (2 piece cans), i.e. those bodies with no lap or two thicknesses where the joint is obtained by folds soldered with tin or lead or thermoplasts, a condition which renders this new can infeasible.

The new metallic can and its manufacturing process as stated before is represented in the attached drawings which show, for comparison purposes, both the cut-out discs of the top and end, as well as the fixed parts and the can body, with their respective dimensions, as follows:

FIG. 5 is a top view of a disc designed for the top and end of a can, cut with the normally used diameter employed with conventional seaming process;

FIG. 6 is a top view of a disc designed for the top and end of a can, cut with a considerably smaller diameter, used for the micro-seaming and in accordance to the object of the new process;

FIG. 7 is a top view of an already stamped top and end of a can, according to the dimensions used for conventional seaming process;

FIG. 8 is a top view of an already stamped top and end of a can, according to the dimensions used for the new seaming process;

FIG. 9 is a sectional view of an already stamped top and end of a can, showing the profile and curling dimensions used for conventional seaming process;

FIG. 10 is a sectional view of an already stamped top and end of a can, showing the profile and reduction of curling dimensions for the new seaming process;

Figure 15:
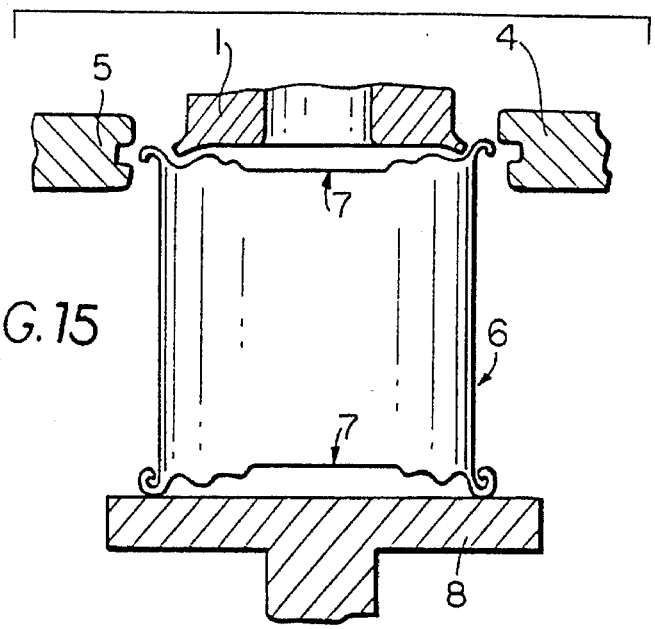
FIG. 15 is a diagram of seamer head chuck and rolls used for seaming the cans.

Describing in more detail the new can and its manufacturing process consists in using seaming equipment well known in the art. Seaming operations are currently effected by using a type of machine of which the essential components are comprised of at least (FIG. 15); one or more stations for the closing machine, having a base plate 8, a seaming chuck 1, at least one first operation roll 4, and one second operation roll 5. The base plate, or can holding chuck, of the machine, supports the can body 6. The snug fitting seaming chuck holds the can cover (can end) 7 in place on the can body and acts as a back-up for the seaming roll pressure.

Figure 16:
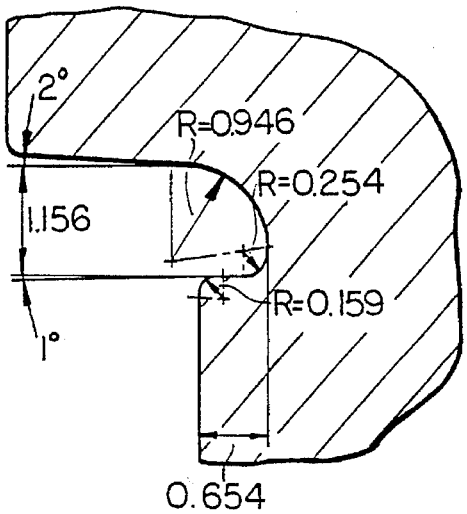
FIG. 16 shows a profile and dimensions of a first seam roll for micro-seam.
Figure 17:
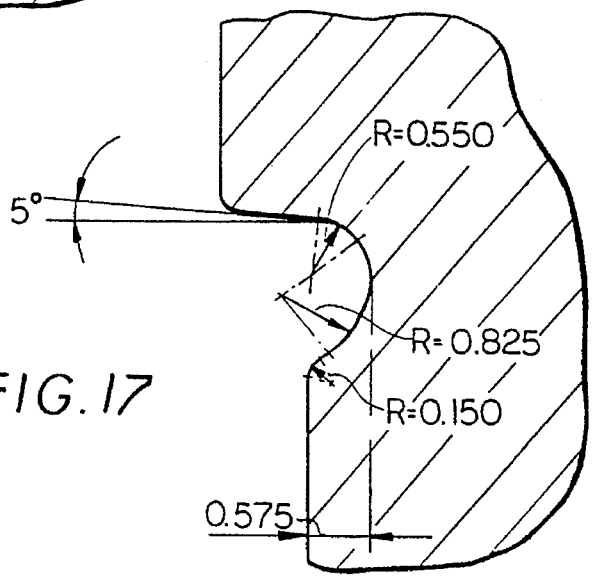
FIG. 17 shows a profile and dimensions of a second seam roll for micro-seam.
Figure 18:
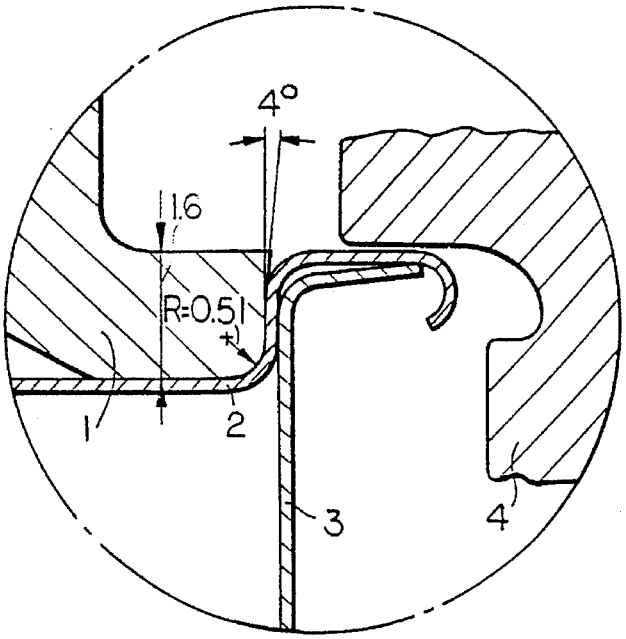
FIG. 18 is a side view of the cover or can end and the can body before the first seaming operation.
Figure 19:
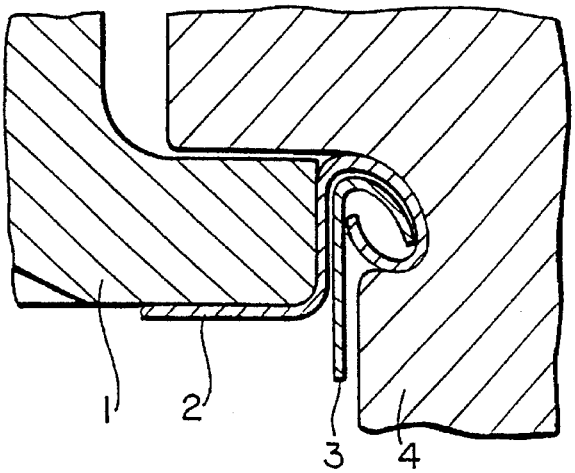
FIG. 19 is a side view of the micro-seam after the first seam roll operation.
Figure 20:
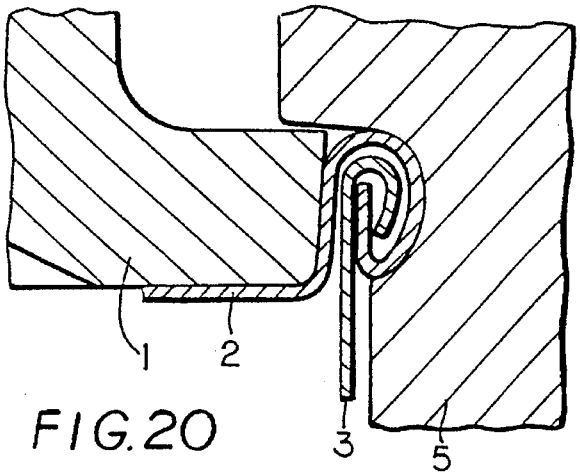
FIG. 20 is a side view of the micro-seam after the second seam roll operation.

The current micro-seaming uses seaming equipment exactly the same as the traditional seaming equipment described above, except for the redesigning and redimensioning of the first and second operation rolls (FIGS. 16 and 17).

Figure 21:
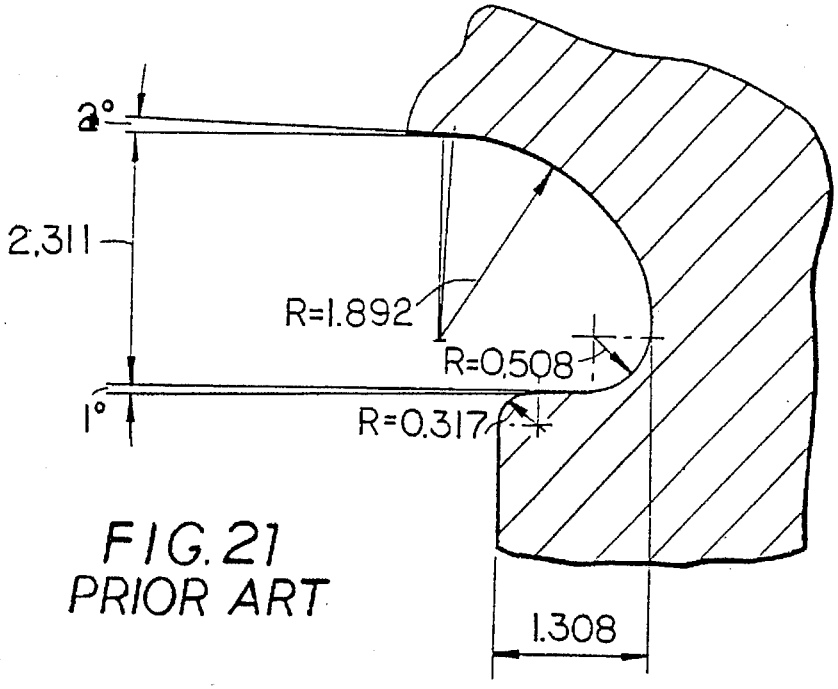
FIG. 21 PRIOR ART
FIG. 21 shows a profile and dimensions of a first seam roll for conventional seam.
Figure 22:
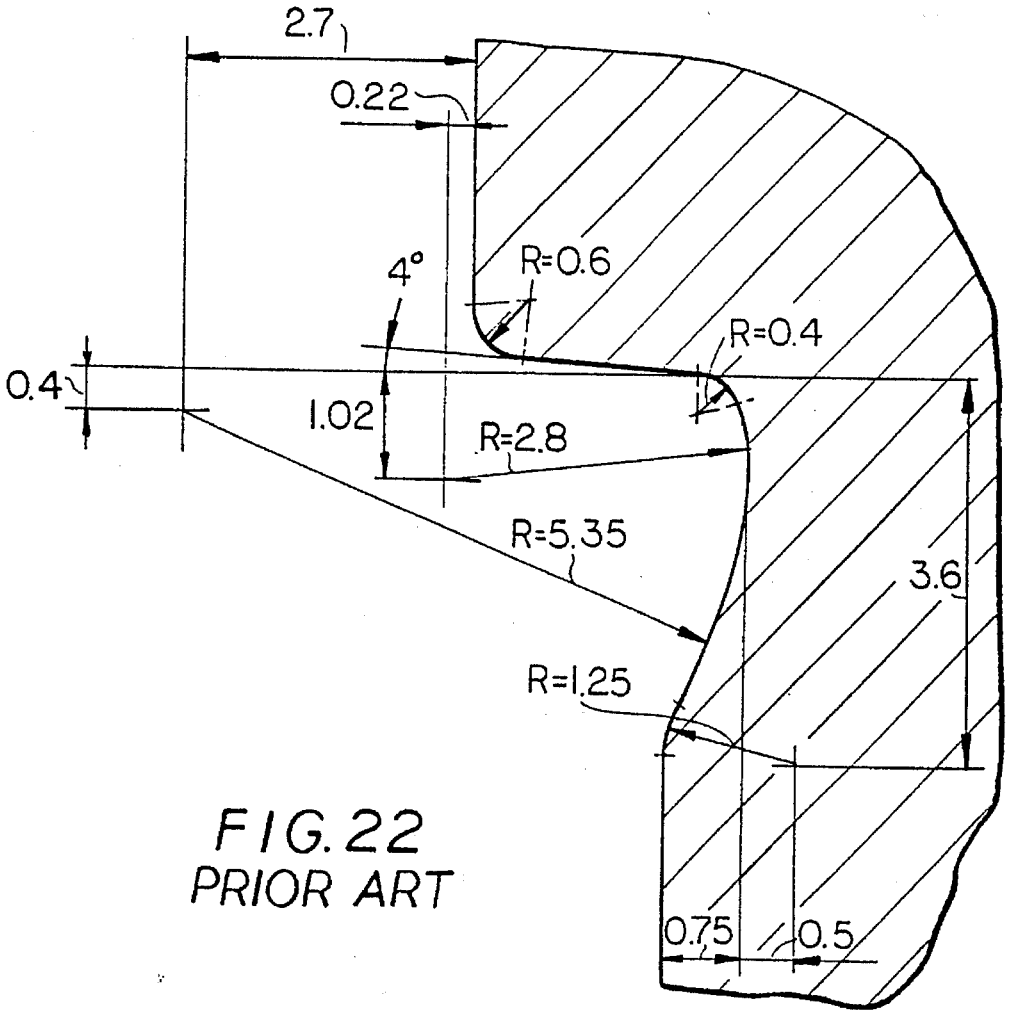
FIG. 22 PRIOR ART
FIG. 22 shows a profile and dimensions of a second seam roll for conventional seam.

The redesigning and redimensioning of the first and second operation rolls vary according to the thickness and hardness of the metallic material as well as the diameter of the can. This applies both to cans produced by micro-seaming and cans produced by conventional seaming. Therefore, the designs and dimensions of the first and second operation rolls shown in FIGS. 16 and 17 are valid for micro-seaming can ends (to bodies of cans) with 73 mm diameter produced with 0.16 mm thick material and DR8 temper. Comparatively the FIGS. 21 and 22 show the designs and dimensions of the first and second operation rolls for conventionally seaming can ends (to bodies of cans) with 73 mm diameter produced with 0.22 thick material and T61 hardness.

The above example is one illustration of micro-seaming. It is understood that other dimensions can be used for micro-seaming and the present application is not limited to this one example.

Consequently, for can ends having diameters greater or smaller than 73 mm, the measurements shown in FIGS. 16, 17, 21 and 22 (units are calibrated in mm) should be revised accordingly with reference to the above illustrated example. This applies both to conventional seaming and micro-seaming.

All the stages of formation of micro-seam are illustrated in FIGS. 18, 19, 20 and 2. In the first operation, FIGS. 18 and 19, the micro-curl of the end 2 is interlocked (sometimes referred to as engaged) with the micro-flange 3 of the can body of a first operation roll 4 having a specially contoured groove to be pressed against the seaming chuck 1. After the first seam operation is completed, the first operation roll is retracted and no longer contacts the can cover (can end). The second operation roll 5 (FIG. 20) has a different groove profile from that of the first operation roll. This groove is flatter than the first operation groove and is designed to press the preformed hooks together; to iron out wrinkles in the cover hook and to obtain micro-seam tightness. A good and uniform seaming is obtained with this new can manufacturing process and With special measurements in the cover hook, body hook, overlay A, length of the micro-seam and other folds (see FIG. 2).

Figure 1:
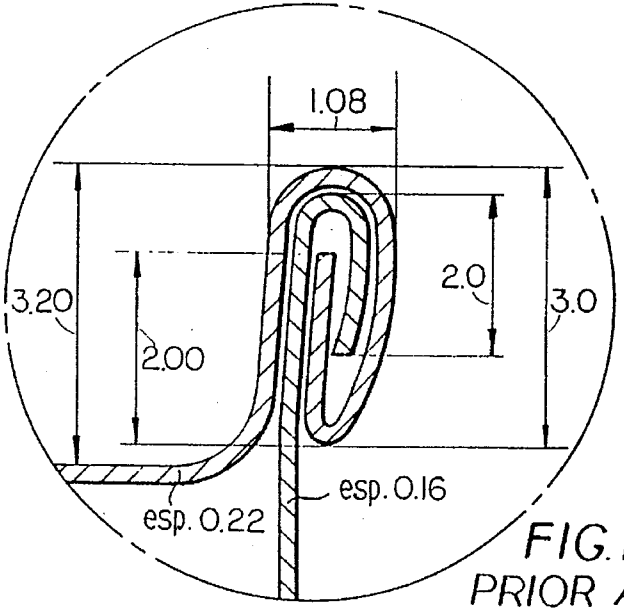
FIG. 1 PRIOR ART
FIG. 1 is a sectional view, showing the seam obtained by the conventional process, i.e. by employing a metal sheet of 0.22 mm thickness, with relatively larger seaming dimensions.
Figure 11:
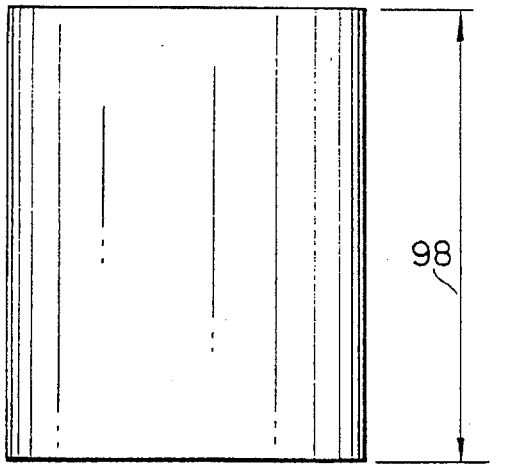
FIG. 11 PRIOR ART
FIG. 11 is a side view of a cylindrical can body with the height dimension designed for conventional seaming process.
Figure 12:
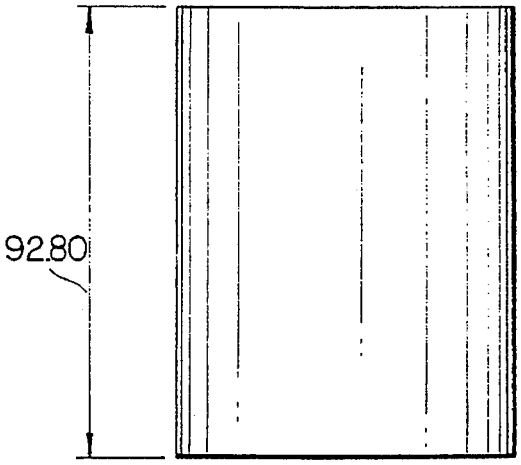
FIG. 12 is a side view of a cylindrical can body with the considerably reduced height, designed for the new micro-seaming process.
Figure 13:
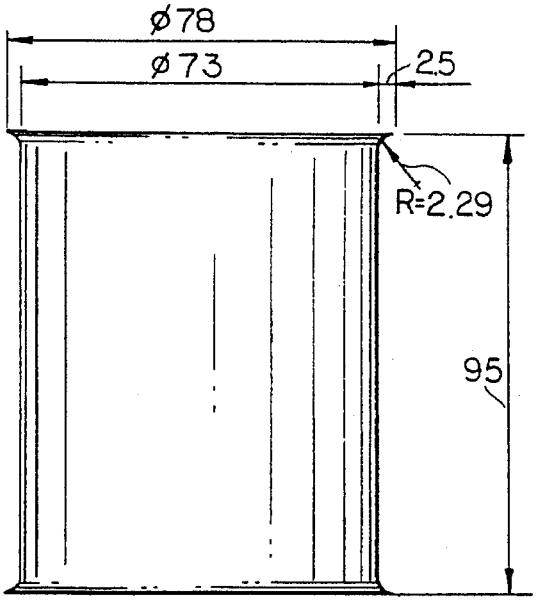
FIG. 13 PRIOR ART
FIG. 13 is a side view of a flanged can body, and its dimensions normally used for conventional seaming process.
Figure 14:
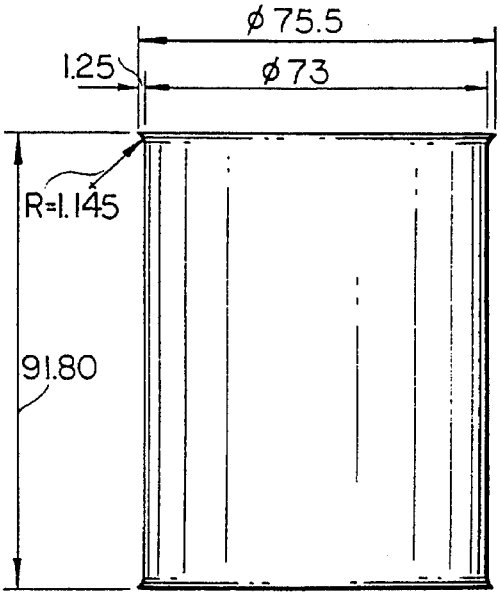
FIG. 14 is a side view of a flanged can body showing considerably reduced dimensions according to the micro-seaming process.
Figure 23:
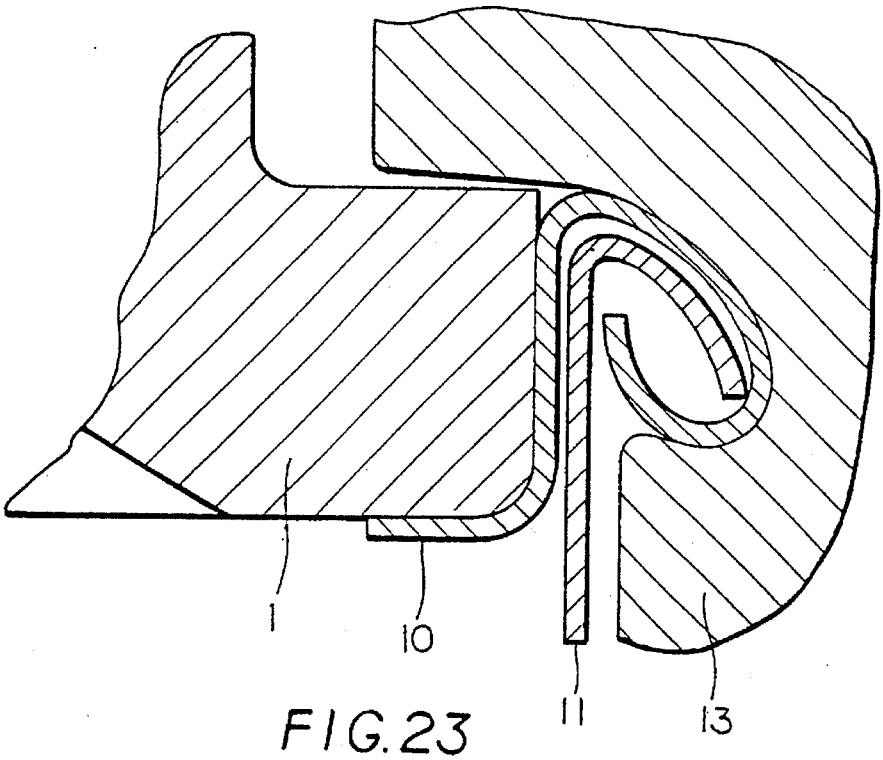
FIG. 23 PRIOR ART
FIG. 23 is a side view of the conventional seam after the first seam roll operation.
Figure 24:
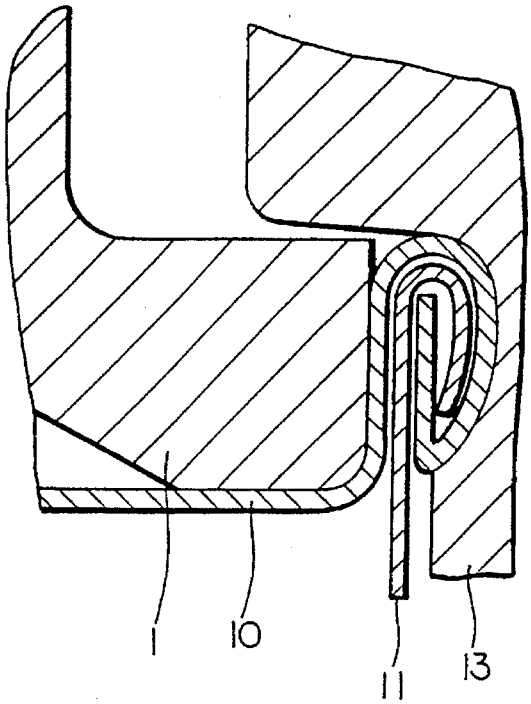
FIG. 24 PRIOR ART
FIG. 24 is a side view of the conventional seam after the second seam roll operation.

The designing of the curves and dimensioning of the first and second operation rolls for a conventional seam are shown in FIGS. 21 and 22. All the stages of formation of a conventional seam are illustrated in FIGS. 23 and 24. In the first operation, FIG. 23, the curling of the can end 10 is interlocked with the flange 11 of the can body of a first operation roll 12 having a specially contoured groove to be pressed against the seaming chuck 1. After the first seam operation is completed, the first operation roll 12 is retracted and no longer contacts the can cover (can end). The second operation roll 13 (FIG. 24) has a different groove profile from that of the first operation roll. This groove is flatter than the first operation groove and is designed to press the preformed hooks together to obtain a seam tightness with special measurements in the cover hook, body hook, length of seam and other folds (see FIG. 1).

The micro-seam improvements enables one to obtain cans with substantial materials savings, due to the use of a thinner metal sheet, i.e. of 0.16 mm thickness which is relatively harder, and i.e. with DR8 temper, thus replacing the conventionally used metal sheet for the known seaming process, what is where normally employed is a metal sheet of 0.22 to 0.24 mm, which is relatively softer, and this without affecting the volumetric capacity of the cans thus obtained.

Figure 4:
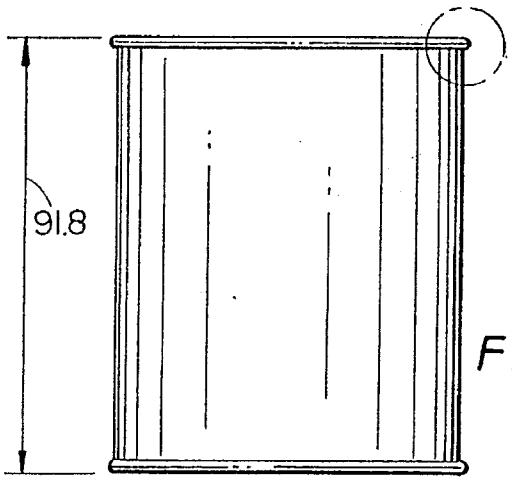
FIG. 4 is a side view of a ready or seamed can, the seam of which has been obtained by the new process, the height of its body showing to be considerably lower, without changing its volumetric capacity.
Figure 3:
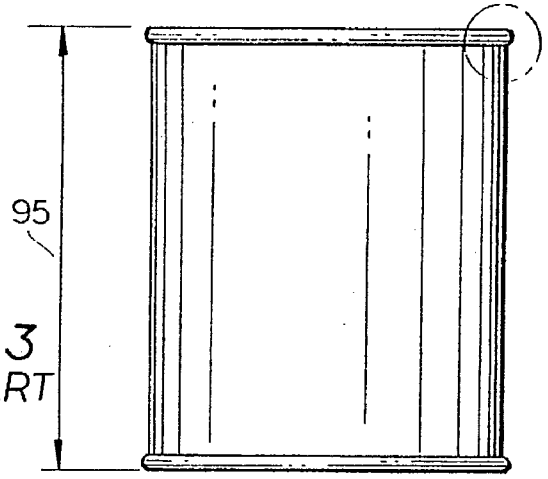
FIG. 3 PRIOR ART
FIG. 3 is a side view of a ready or seamed can with conventional seam, the height of its body being considerably greater as compared to the can obtained by the new seaming process.
Figure 2:
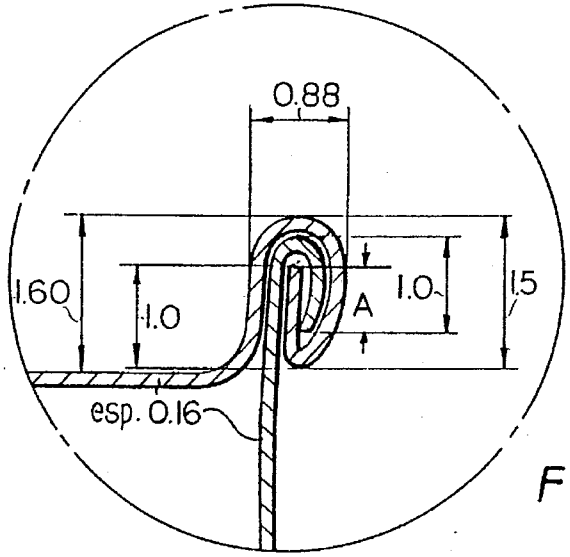
FIG. 2 is a sectional view, showing a micro-seam obtained by the new process, i.e. by employing a metal sheet of lesser thickness, i.e. 0.16 mm and a harder one, i.e. with DR8 temper, of which the seaming dimensions are considerably reduced in comparison with the conventional process.

This new can provides for many advantageous material savings, these savings result from the considerable reduction of the diameters of the discs which form the top and the end of a can, as shown in FIGS. 5 and 6, as well as a reduction of the hooks dimensions and other seaming dimensions, as shown in FIGS. 1 and 2, and FIGS. 9 and 10. In addition, more material savings result from a reduction of the height of the cylindrical body of the can, as shown on FIGS. 3 and 4 and on FIGS. 11 through 14 of the attached drawings. These reductions are obtained without affecting the volumetric capacity of the cans thus obtained through the new micro-seaming process.

For a perfect evaluation of the actual advantages resulting from this new can it is worthwhile to note that, in addition to this substantial materials savings, allowed by the use of a double reduced metal sheet, i.e. with DR8 temper and 0.16 mm thickness in manufacturing the tops and ends of cans, the use of this lower price metal is not possible for the conventional type of seaming. The high hardness of the material and its thinness would cause the folds on the hooks to develop enormous deformations which would be transmitted into a general seaming deformation which, in addition to an extremely bad appearance of the can, leading to its technical condemnation for not providing a perfect seal and, consequently, an ideal hermetic seam, which represent the fundamental requirements for a good seaming and quality of these containers.

I claim:

1. A metallic can having a microseam formed between a can end and s can body providing reduction of cover hooks and body hooks as well as length of seam, countersink of seam and overlap of seam, comprising: a flanged body of a can having a reduced flange and at least one curled can end having a reduced curl, and said curled can end having profile and curling dimensions necessary for connecting the curled can end to the reduced flange can body;, said microseam having a reduced length of substantially 1.50 mm, a reduced body hook of substantially 1.0 mm, a reduced cover hook of substantially 1.0 mm, a reduced countersink of substantially 1.60 mm, and a reduced overlap, and wherein the microseam is substantially free from wrinkles and folds on the cover hook, and forms a hermetic seal.

2. The can according to claim 1, wherein said can end is made of metallic sheet material double reduced.

3. The can according to claim 2, wherein the double reduced material has a thickness of approximately 0.12 mm to 0.24 mm.

4. The can according to claim 1, wherein said can end is made of metallic sheet material single reduced.

5. The can according to claim 4, wherein the single reduced material has a thickness of approximately 0.18 mm to 0.24 min.

6. The can according to claim 1, wherein said can body is made of metallic sheet material double reduced.

7. The can according to claim 6, wherein the double reduced material has a thickness of approximately 0.12 mm to 0.24 mm.

8. The can according to claim 1, wherein said can body is made of metallic sheet material single reduced.

9. The can according to claim 8, wherein the single reduced material has a thickness of approximately 0.18 mm to 0.24 mm.

10. The can according to claim 1, wherein said can has the same volumetric capacity, independent of the substantial reductions, as a conventional can made from non-reduced metallic sheet material.

* * * * *